US005421280A

United States Patent [19]

Gast

[11] Patent Number: 5,421,280

[45] Date of Patent: Jun. 6, 1995

[54] ANCHOR CHAIN ORIENTATION LINK

[76] Inventor: Peter A. Gast, 25 Mattapoisett Neck Rd., Mattapoisett, Mass. 02739

[21] Appl. No.: 186,425

[22] Filed: Jan. 25, 1994

[51] Int. Cl.[6] ..... B63B 21/24

[52] U.S. Cl. ..... 114/221 R; 114/294

[58] Field of Search ..... 59/84, 90, 93; 114/210, 114/293-310, 179, 181, 221 R; D12/215

[56] References Cited

U.S. PATENT DOCUMENTS

| | | | |
|---|---|---|---|
| 324,262 | 8/1885 | Kramer | 114/181 |
| 1,640,672 | 8/1927 | Schauman | 114/210 |
| 4,864,955 | 9/1989 | Bruce | 114/210 |

*Primary Examiner*—Edwin L. Swinehart

[57] ABSTRACT

An anchor chain orientation link having a longitudinal curved body having a curved radius defined by the diameter of a bow roller for guiding an anchor chain wherein the orientation link is fastened between an anchor rope or "rode" and an anchor chain such that when the anchor rope was hauled aboard a vessel, the chain is turned to a selected orientation. In particular, as the curved body comes in contact with the bow roller, said roller acts as a fulcrum such that the curved body acts as a crank due to its curved shape causing the link to rotate until it rotates to a stable position. This stable position has been preselected to establish the orientation of the anchor with respect to the roller and therefore to the vessel on which the roller is mounted. An anchor chain orientation link adapted with an attachment means for a line at one end, and an attachment means for a load at the other end, and a body means adapted to form a crank so as to rotate about a line of action when said link is pulled over a firm surface such as a roller so as to cause said attachment means for a load end to be operatively oriented to a desired position.

4 Claims, 6 Drawing Sheets

ANCHOR CHAIN ORIENTATION LINK

BACKGROUND OF THE INVENTION

The invention relates to controlled hoisting of a load by biasing of a chain, particularly to an improved curved link for rotating an anchor chain for orienting the anchor to a selected relationship with a windlass mechanism as it is hauled aboard a vessel.

DESCRIPTION OF PRIOR ART

Observing anchors being raised over bow rollers and chocks of a windlass device, I have noticed a need for a way to control the rotational orientation of the anchor and chain as the anchor is winched-in and approaches the position to be hauled aboard over the bow rollers and chocks such that the anchor does not become fouled with the rollers and chocks or damages the hull of the vessel. A problem arises when flukes attached to the anchor face a direction other than the preferred one which is that of a plane parallel to the axis of the roller. Mariners commonly use some length of chain consisting of a plurality of links, at least four feet in length, fastened to the anchor at one end and fastened to an anchor line at the other. Heretofore, if the chain with attached anchor happened to be hauled from the seabed unfavorably oriented so as to interfere with the hauling aboard over the roller, it would be lowered several feet while the chain was turned by hand, and then raised again and hauled aboard, if successfully rotated to the preferred position. This adjustment can be done by hand with anchors weighing less than 40 pounds; however, heavier anchors, such as those weighing more than 40 pounds make the task of rotating the chain and anchor hanging over a roller very difficult.

Applicant is aware of prior art devices which have attempted to solve this problem. The closest prior art being found in Bruce's patent, U.S. Pat. No. 4,864,955, disclosing a machine for stern anchors of large ships. The more complicated Bruce device is so much larger than the attached cables and chains, its size restricts its usage through openings which it must pass, such as bow roller cheek or pulley blocks. When used on v-shaped or wasted rollers, which have a smaller diameter at their middle than a cylindrical roller, rotational orientation doesn't always take place. When lowering the anchor, the Bruce device can catch on the bow roller, side plates or corners requiring operator assistance to lift it off.

OBJECTS AND ADVANTAGES

Accordingly, the object and advantage of my invention is to provide an anchor chain orientation link having the capability of controlled repetition of rotational orientation of an anchor connected to a chain such that the anchor assumes a preset orientation relative to an associated vessel. My device works well with bow rollers in use today which are used in connection with a windlass device, or are manually operated. The size of my invention is no larger than the shackles, chain links and chain thimbles used in connection with a length of chain so that it freely passes through hawseholes provided in the vessel for accepting anchor chains and by existing fixtures of current anchor roller mechanisms. Accordingly, a large cylindrical surface is not necessary to accommodate my device. Being free of cams, lands, and reinforcement plates, my invention will not catch on corners of cheeks or side plates of rollers when passing in either direction over the rollers and it returns from the seabed free of impacted mud. A slow hauling line speed is optional when using my link. It's simplicity and advantages will be apparent from the consideration of the following drawings and specifications.

Furthermore, it is desirable to provide for a new and improved anchor chain orientation link that is economical, lightweight, trouble free and to provide for consistent, accurate controlled orientation of a load particularly an anchor which overcomes at least some of the disadvantages of the prior art.

SUMMARY OF THE INVENTION

The present invention is directed a combination chain and chain orientation link for the controlled hoisting of a load by rotational biasing of the chain. In particular the invention relates to an improved curved link for rotating an anchor chain for orienting an anchor to a preset relationship to a roller device of a windlass mechanism mounted on a vessel for orienting the anchor with respect to the roller device as it is hauled aboard a vessel.

While the above embodiment of FIG. 1 describes the use of my invention to orient the anchor which is hauled aboard over a roller of a boat, it will be understood that my invention could be used to orient any load or a chain in other situations. For example, my device could be used to orient fishing gear such as traps or drags when hauled, so that a preferred side of the gear is positioned toward the boat. My device could be used in a helicopter's retrieval line, oceanographic research devices, or any such load hanging from a turning block in which repeat rotational orientation is preferred. While my above description contains many specificities, these should not be construed as limitations on the scope of my invention, but rather as an exemplification of preferred embodiment thereof. Many other variations are possible. Attachment eyes can be elongated and rotated. The eyes can be connecting devices such as but not limited to screw threads, shackles, hooks, or clevises. The body could have a more complicated curved shape, varying in length and diameter. It could be modified to include a singe bend or a combination of curves and bends, so that rotational orientation and stability is achieved at the load end. The load could be fastened directly to the link without chain, using only a rotational limiting shackle or clevis. Accordingly, the scope of the invention should be determined not by the embodiments illustrated, but by their appended claims and their legal equivalents.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
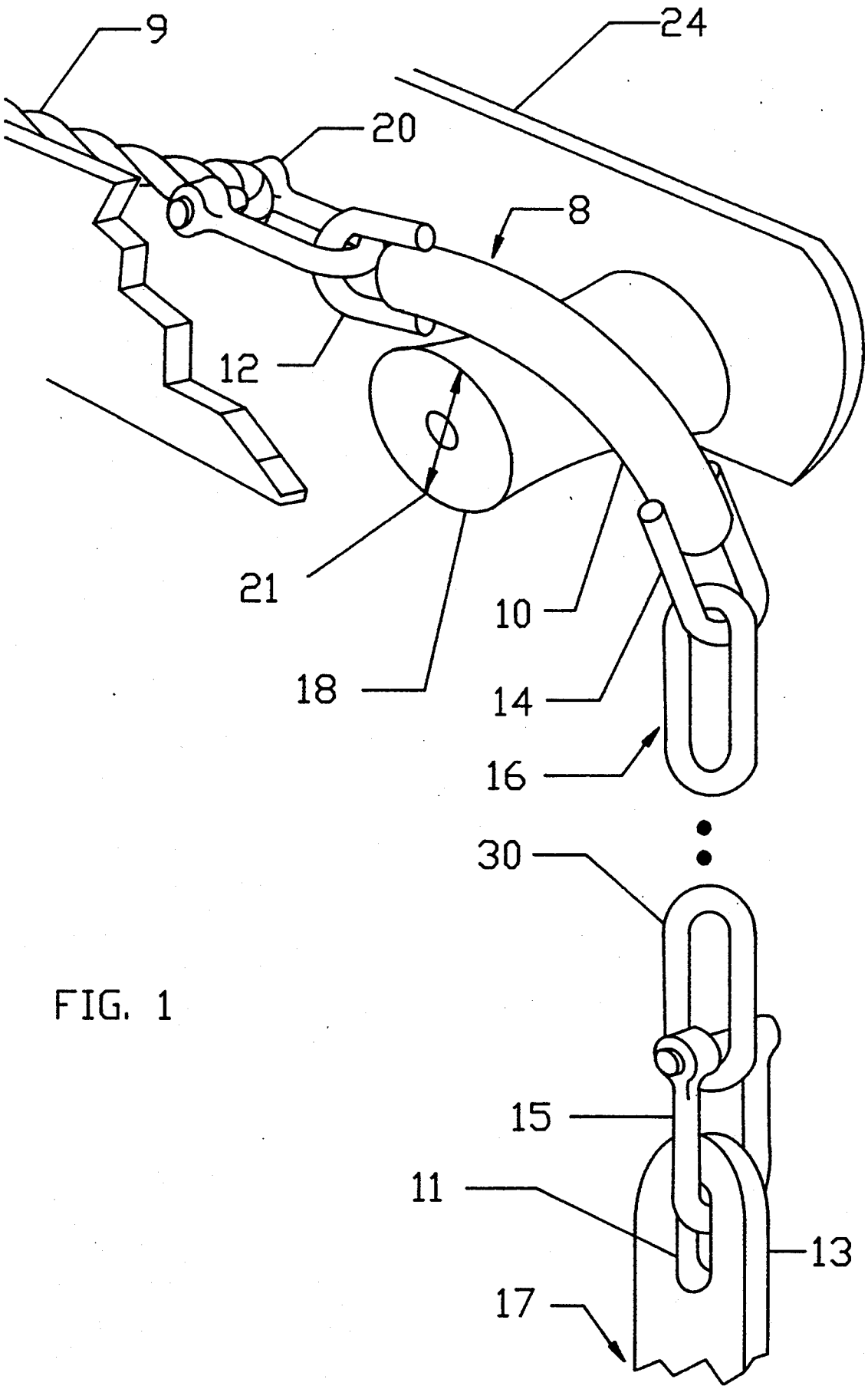
FIG. 1 shows a perspective view of an anchor chain orientation link with its side of stability positioned on a roller in accordance with the present invention.

Referring to FIG. 1, a preferred embodiment of an anchor chain orientation link 8 is provided for orienting a marine anchor 17 as it is hauled over roller 18 positioned on a vessel typically at the bow 6. Said link 8 includes an elongated curved body 10, first eye 12 for attachment to line 9, and second eye 14 for attachment to chain 16 having a plurality of links and having a first and second end that is attached with shackle 15 to anchor 17.

Figure 5:
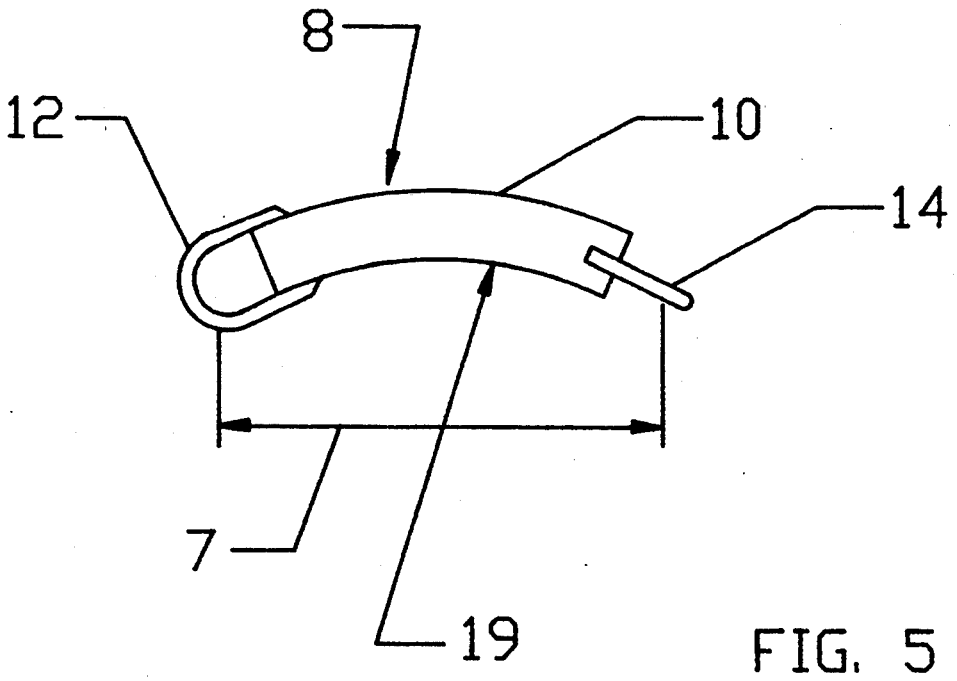
FIG. 5 shows a side view of the anchor chain orientation link of FIG. 1., the line of action, and the radius of curvature of the body.

Preferably body 10 has a radius of curvature 19 approximately two times the diameter 21 of roller 18, and has a length approximately to the radius (see FIG. 3) of curvature 19 as is shown in FIGS. 5.

Preferably body 10 is rounded in cross section, and of sufficient strength to resist straightening, preferably constructed of metal. As is shown in FIG. 5 a common centerline of eye 12 and eye 14 lie in coplanar relationship inside radius of curvature 19 at mid-length of body 10. Preferably said common centerline lies outside the surface of body 10 at mid-length.

In the preferred embodiment shown in FIG. 1, eye 12 is configured of a chain link of suitable size and strength, attached by weld to body 10. Said eye will allow the passage of shackle 20 for fastening to the vessel's line 9, commonly called an anchor rode.

Preferably the axis of eye 12 does not lie normal or coplanar to the plane of curvature of body 10, but at an acute angle of approximately twenty degrees. Eye 14 at the other end is a chain link similar to eye 12, welded to body 10.

Figure 2:
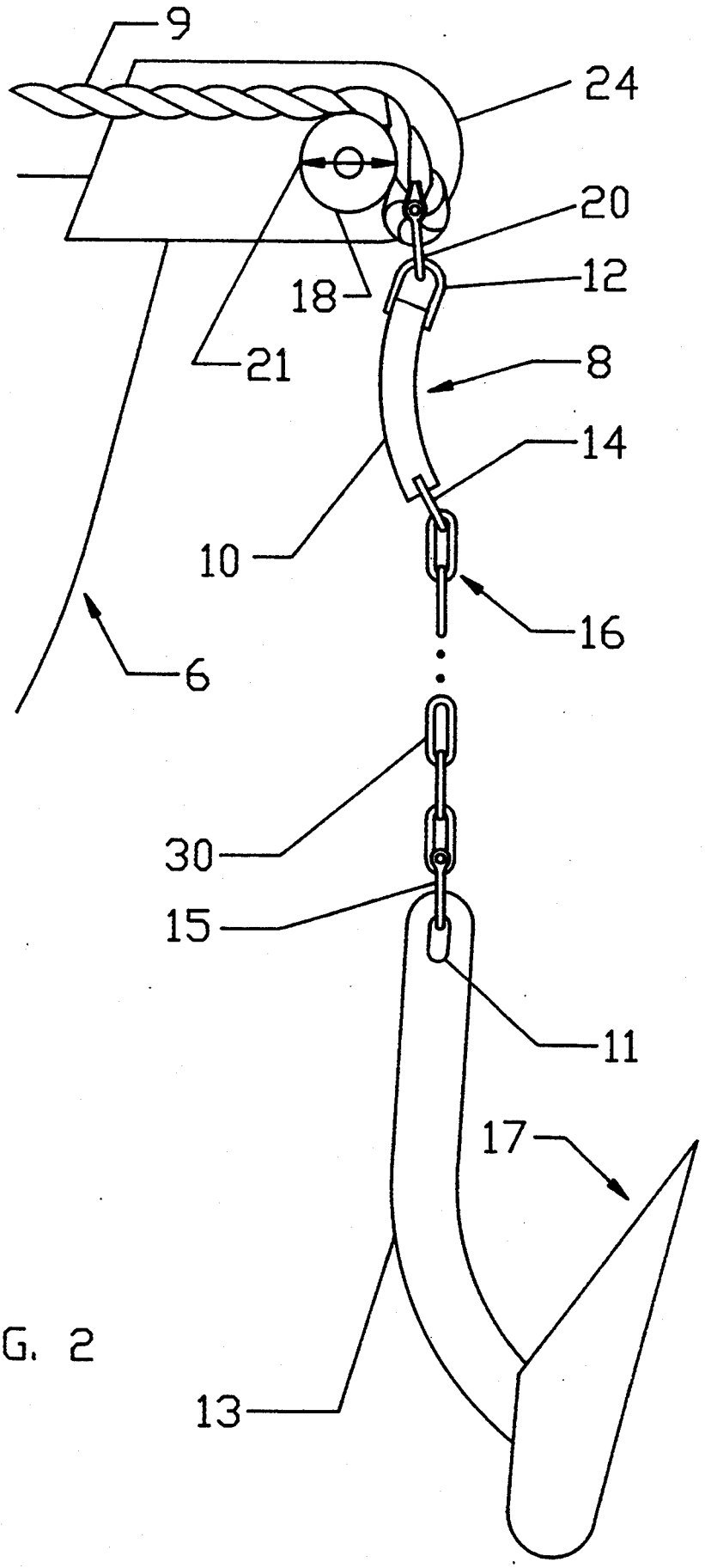
FIG. 2 shows a side view of the link before roller contact of the anchor chain orientation link of FIG. 1.
Figure 4:
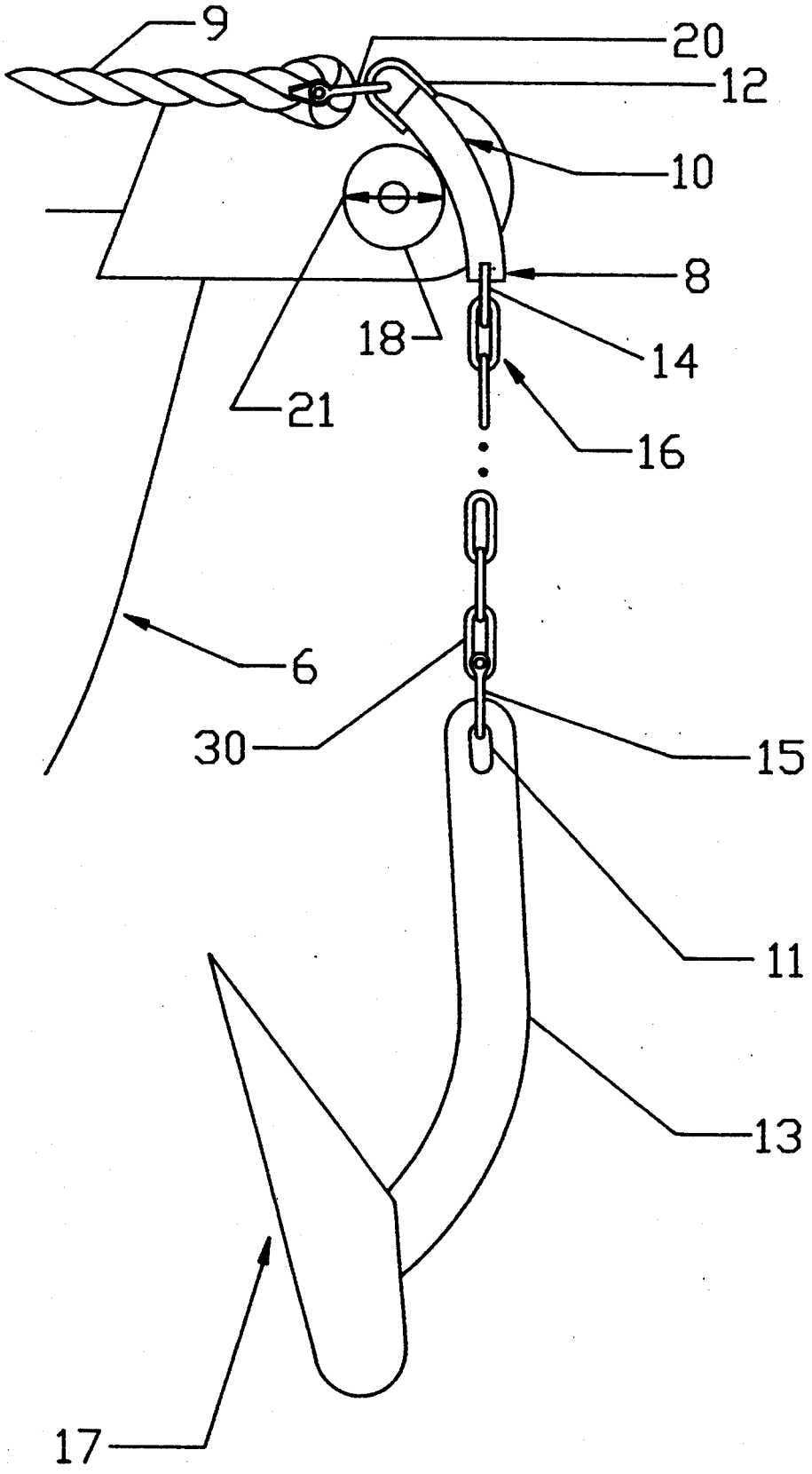
FIG. 4 shows a side view of the anchor chain orientation link of FIG. 1. in the operative orientation position of stability.

Preferably length of chain 16 is attached to eye 14. The axis of eye 14 is coplanar to radius of curvature 19 when length of chain 16 is permanently linked into eye 14 as shown in FIG. 1. By choosing the orientation of the last link 30, as is shown in FIG. 2, of chain 16 when considering the shank 13 and shackle 15 connection, any desired orientation of anchor 17 can be achieved. In the preferred embodiment the tines of the anchor are parallel to the axis of said roller as is shown in FIG. 4.

Figure 6:
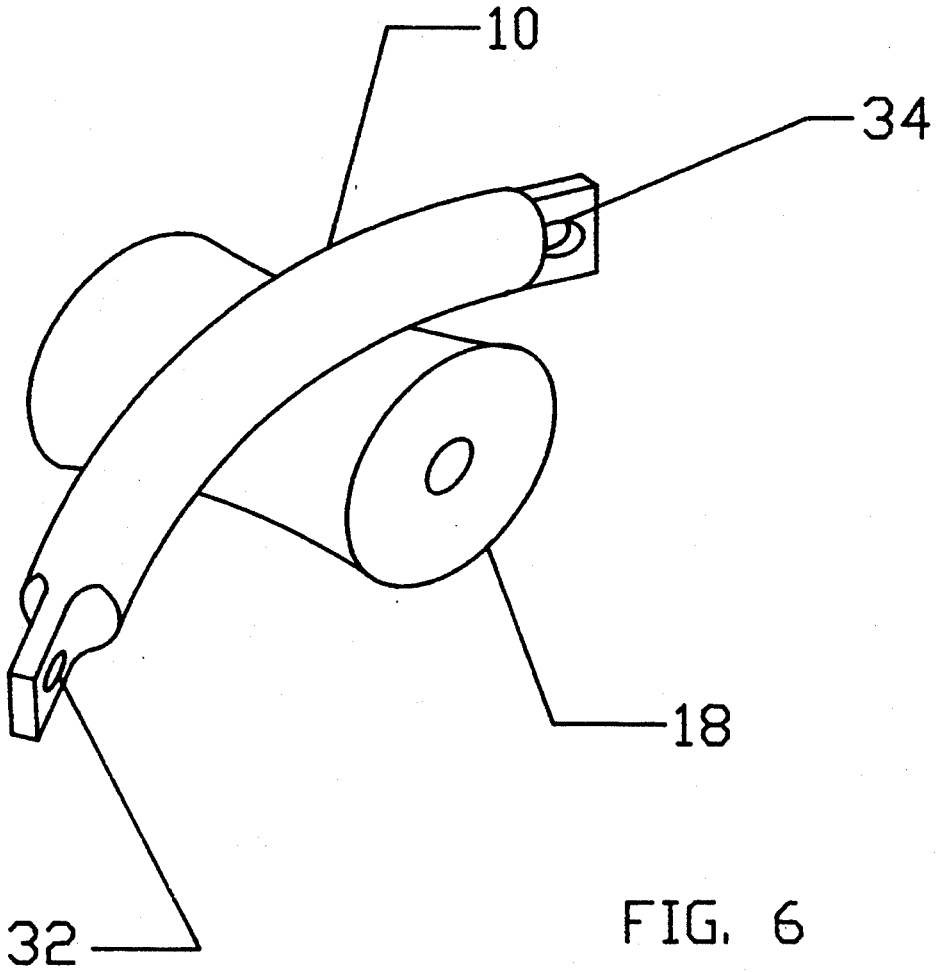
FIG. 6 shows a perspective side view of another embodiment of a chain orientation link.

Referring to FIG. 6, which shows another embodiment of an anchor chain orientation link, when a shackle is used in eye 32 to attach a chain or anchor, eye 34, positioned at the opposite end of the body 10 should be positioned so that the axis of eye 14 is normal to the plane of curvature of body 10. This creates stability and decreases resistance to being hauled over a firm surface.

Figure 7:
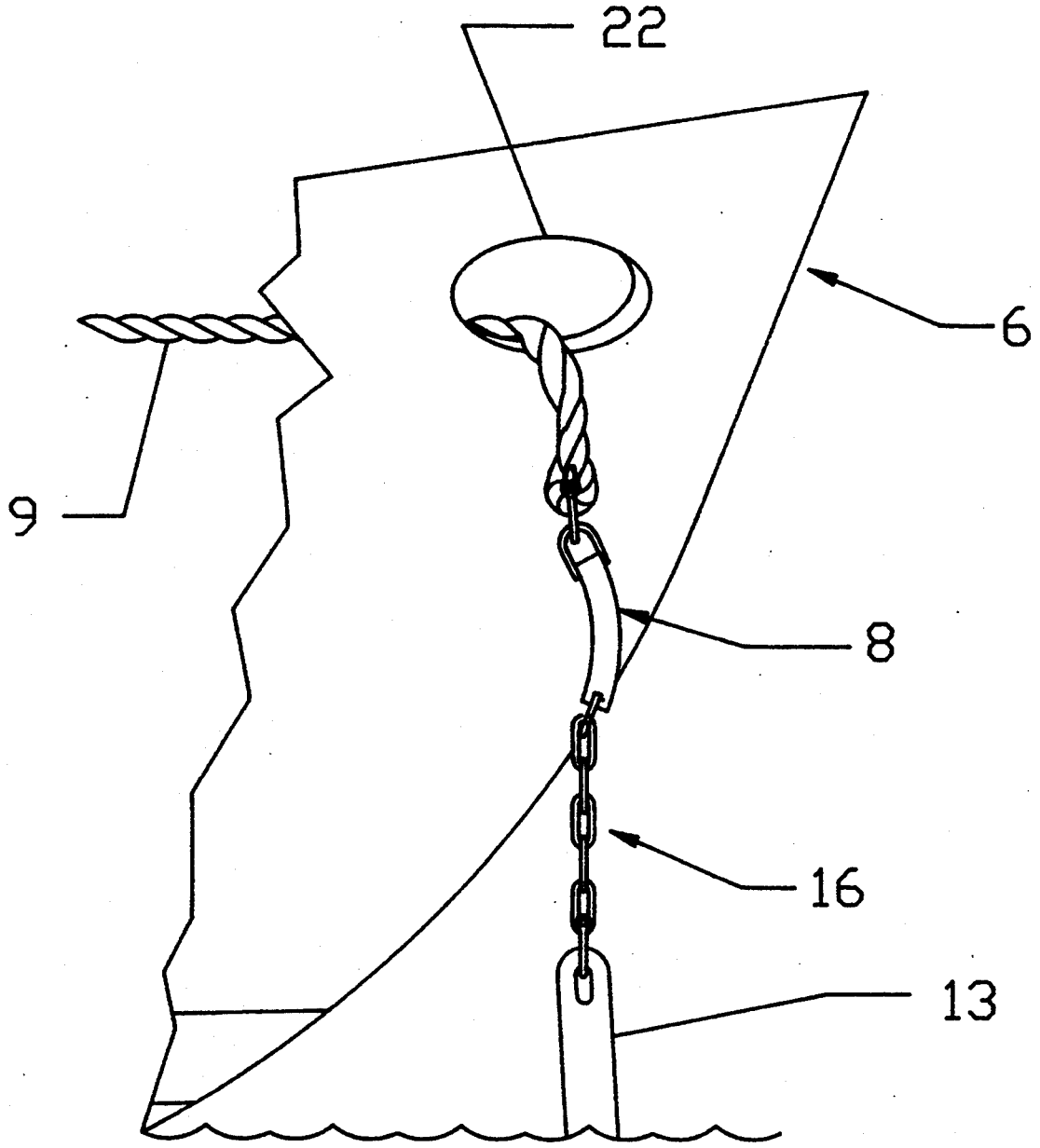
FIG. 7 shows a side view of an anchor rode and the anchor chain orientation link of FIG. 1. through a hawsehole of a vessel.

FIG. 7 shows the chain orientation link 8 being hauled through a hawsehole 22. Minimal hawsehole size remains a function of the chain and shackles, which are larger than the orientation link.

Body 10 is to be made of metal or a material of suitable strength.

OPERATION OF INVENTION

Figure 3:
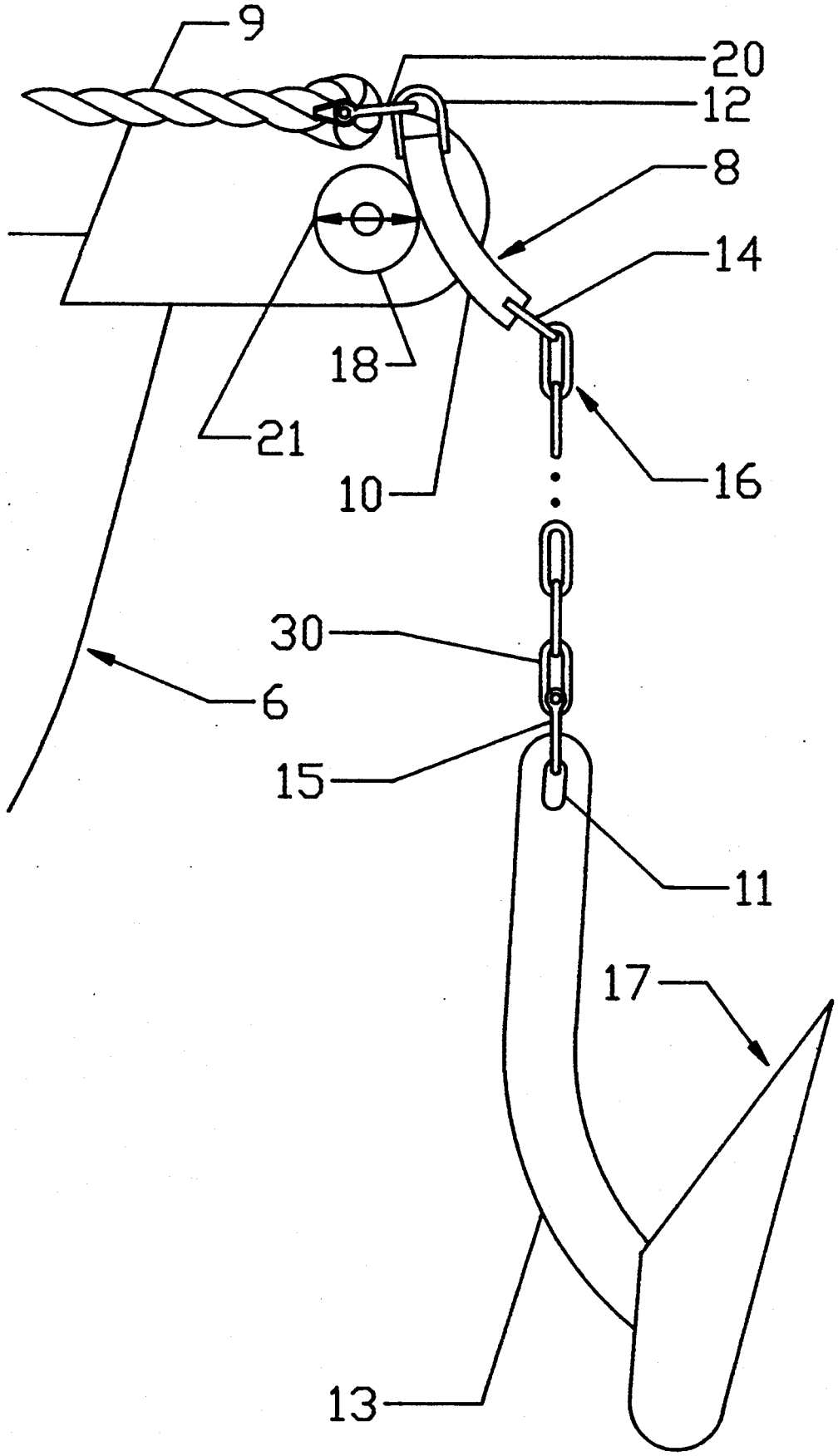
FIG. 3 shows a side view of the anchor chain orientation link of FIG. 1. in the position where operative orientation occurs, in a position of instability.

Referring to FIG. 1, operation of the anchor chain orientation link 8 is shown by fastening an anchor rode or line 9 to eye 12, and an anchor 17 to chain 16. While a vessel is at anchor, line 9, which could be a rope, cable, or chain, lies randomly rotated on roller 18 mounted on the deck of the vessel. It is desired that shank 13 be orientated in some particular chosen rotational aspect. Referring to FIGS. 2 and 5, before the link contacts roller 18, there exists a common line of action 7 between connecting eyes 12 and 14, which represents the line and load forces. Referring to FIG. 3, when curved body 10 randomly bears upon roller 18, acting as a fulcrum, the device acts as a crank for transmitting rotary motion, due to its elongated curved shape which acts as a lever arm when drawn over a roller, and is in an unstable torque producing position. Line and load forces at eye 12 and eye 14 respectively, opposed by the supporting force of roller 18, causes a torque on body 10 about line of action 7. This torque causes the link to rotate until it rotates to the stable position of FIG. 4. This rotational position of stability of body 10 extends to eye 14 adjacent chain 16.

Referring to FIGS. 1 through 4, the rotational orientation of body 10 happens rapidly, so reduced hauling speeds are optional. Line 9 can be hauled by hand or by a vessel's windlass. Although anchor 17 can be fastened to eye 14, having more than a foot of chain 16 allows a preferred slower turning motion. Length of chain 16 being hauled over roller 18 will maintain rotational orientation if not allowed to slacken.

Preferably length of chain 16 should allow anchor 17 to be below the water's surface several feet when body 10 passes over roller 18. The flexibility of chain 16 combined with the dampening effect of the water, makes for a smooth rotational change. Following body 10 over roller 18, chain 16 will hold the orientation set by body 10 as it is hauled, resulting in anchor 17 being favorably positioned before it contacts roller 18.

What is claimed is:

1. An orientation device in combination with a roller comprising:

a) roller means for providing a fulcrum for turning an anchor chain comprising a roller consisting of a cylindrical roller having a defined diameter mounted on a shaft defining an axis of said roller;

a) a curved elongated body having a radius of curvature not less than one half times the diameter of said roller and not greater than eight times the diameter of said roller and extending between a first attachment eye and a second attachment eye, said curved elongate body having a stable position and an unstable position arranged to rotate about a line of action extending between a one end and an opposite end having:

i) a rope attachment means at said one end; and ii) a chain attachment means at said opposite end for in-line connection to a rope means at one end and a chain means at the opposite end, the chain means in turn being attached to an anchor wherein as the orientation device is drawn over a fulcrum means, to raise said anchor, said orientation device rotates between the unstable to the stable position to cause orientation of the chain and in turn the anchor.

2. The orientation device of claim 1 wherein the said radius of curvature is approximately equal to the twice the diameter of said roller.

3. The orientation link of claim 1 wherein the said curved body member is positioned in a bent arrangement having a stable position and an unstable position such that as the said curved body member is drawn across said roller said elongated body moves from an unstable position to a stable position thereby imparting rotational movement to the chain means, said curved body member including:

a) a surface of instability derived from the curvature of said body wherein a torque is produced to rotate said link when acted upon by the fulcrum means comprising a roller; and b) a side of stability derived from the curvature of the body means wherein no rotation is produced as said curved body means engages said roller wherein said chain attachment means is characterized by an aperture for connecting with a shackle to a chain cable.

4. The chain orientation link of claim 1 wherein the length of said curved body is approximately equal to said radius of curvature.

* * * * *